US010166785B2

(12) United States Patent
Marco

(10) Patent No.: US 10,166,785 B2
(45) Date of Patent: Jan. 1, 2019

(54) DIRECT PRINTABLE RIGID SUBSTRATE FOR INKJET PRINTING

(71) Applicant: Charta Group, Inc, Austin, TX (US)

(72) Inventor: Albert Marco, Austin, TX (US)

(73) Assignee: Charta Group, Inc

( * ) Notice: Subject to any disclaimer, the term of this patent is extended or adjusted under 35 U.S.C. 154(b) by 0 days.

(21) Appl. No.: 15/427,173

(22) Filed: Feb. 8, 2017

(65) Prior Publication Data

US 2017/0282596 A1 Oct. 5, 2017

Related U.S. Application Data

(60) Provisional application No. 62/316,046, filed on Mar. 31, 2016.

(51) Int. Cl.

| | |
|---|---|
| ***B41J 11/00*** | (2006.01) |
| ***B41J 2/01*** | (2006.01) |
| ***B41M 5/50*** | (2006.01) |
| ***B41M 5/52*** | (2006.01) |
| ***B41M 5/00*** | (2006.01) |

(52) U.S. Cl.

CPC ..... *B41J 11/002* (2013.01); *B41J 2/01* (2013.01); *B41M 5/0047* (2013.01); *B41M 5/508* (2013.01); *B41M 5/5254* (2013.01); *B41M 5/5281* (2013.01); *B41M 5/5218* (2013.01)

(58) Field of Classification Search

CPC ..... B41J 11/002; B41J 2/01

See application file for complete search history.

(56) References Cited

U.S. PATENT DOCUMENTS

2004/0053017 A1* 3/2004 Daems ..... B41M 3/10 428/195.1
2013/0164500 A1* 6/2013 Kasperchik ..... B41M 5/0023 428/148
2014/0196618 A1* 7/2014 Pervan ..... B41J 3/28 101/32

FOREIGN PATENT DOCUMENTS

EP 0904953 A1 3/1999

* cited by examiner

*Primary Examiner* — Bradley Thies

(74) *Attorney, Agent, or Firm* — The Law Firm of H. Dale Langley, Jr., P.C.

(57) ABSTRACT

A method of fixing an artwork on a surface of a rigid substrate includes providing an ink receptive layer comprised of a dispersing pigment in a binder selected from the group consisting of: PVOH, EVA, PUD, latex polymer, and combinations of these, applying the ink receptive layer to the surface of the rigid substrate, drying the ink receptive layer, and printing the artwork onto the ink receptive layer by inkjet.

12 Claims, 2 Drawing Sheets

DIRECT PRINTABLE RIGID SUBSTRATE FOR INKJET PRINTING

CROSS-REFERENCE TO RELATED APPLICATION

The present application is a conversion of and has benefit of priority of the following application, which has at least one same inventor of the present application: U.S. Provisional Patent Application No. 62/316,046, titled "Direct Printable Rigid Substrate for Inkjet Printing", filed Mar. 31, 2016.

FIELD OF INVENTION

The invention is generally related to photography, digital art, and art reproduction and more particularly relates to ink receptive layers for inkjet printing of photo, digital art and art reproduction pieces on various substrates.

BACKGROUND

Stretched or framed pictures are now commonplace and in demand. Conventionally, art studios and sign shops perform a labor intensive process, which includes many detailed steps, to produce stretched or framed pictures of printed art work. These steps include initially printing the art work on a paper, cloth or similar substrate, cutting the substrate to appropriate size, mounting the substrate, and laminating or stretching the substrate on a frame. In the case of lamination, specialized and expensive heaters are required, and heating and cooling times can be significant. In the case of stretchers, significant skill, effort and time is required to form the stretcher frame of required size and shape and to sufficiently position the substrate on the frame. These conventional activities can result in longer turnaround times, lower production capacity and possibly great waste, all of which lead to high costs and extensive steps and processes.

Other conventional techniques include printing the artwork on paper, aligning the paper on a rigid substrate, and then applying high heat (e.g., on the order of 400° F.) and pressure via a heat press. The high heat from the heat press can transfer the artwork to the rigid substrate. The process, however, is time and effort consuming for printing to the paper and heating and cool down for the transfer. Moreover, a sufficient heat press for the transfer is a costly equipment. Even more, the types of rigid substrates that may be employed are limited to those which can withstand the high temperatures involved. This precludes a wide variety of possible rigid substrates, such as acrylic glass or others.

It would therefore be an improvement in the art and technology to provide ink receptive layers to rigid substrates for inkjet printing directly on wide varieties and types of the rigid substrates.

SUMMARY

An embodiment of the invention is a system for producing photo, digital art and art reproduction pieces on various rigid substrates. The system includes an ink receptive layer coated on the rigid substrate, such as metal, wood, plastic or other, which substrate is of suitable thickness, for example, up to about 2 mm, for direct printing with standard inkjet printers onto the ink receptive layer.

Another embodiment of the invention is a method for producing photo, digital art and art reproduction pieces on various rigid substrates. The method includes depositing an ink receptive layer on the rigid substrate and direct printing by an inkjet printer onto the ink receptive layer.

BRIEF DESCRIPTION OF THE DRAWINGS

The present invention is illustrated by way of example and not limitation in the accompanying figures, in which like references indicate similar elements, and in which.

DETAILED DESCRIPTION

Figure 1:
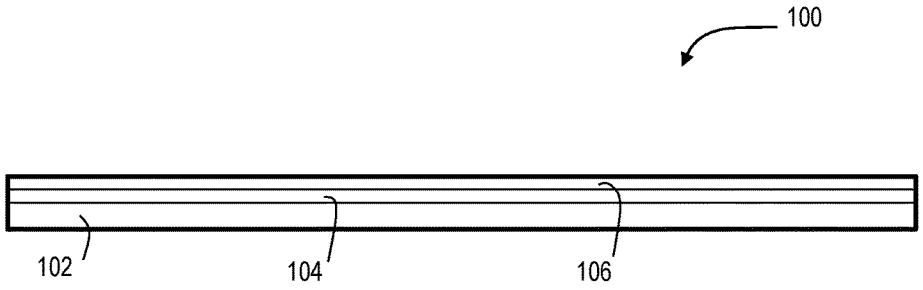
FIG. 1 illustrates a system of an ink receptive layer deposited on a primer or opaque layer atop a rigid substrate, for inkjet printing directly onto the ink receptive layer of a photo, digital art or art reproduction piece, according to certain embodiments.

Referring to FIG. 1, a system 100 includes a rigid substrate 102 coated by a primer or opaque layer 104 and an ink receptive layer 106 atop the primer or opaque layer 104. The rigid substrate 102 is any suitable substrate material that is significantly rigid, as non-exclusive example, a metal, wood, plastic, composite or other. The primer and/or opaque layer 104 of a suitable preparatory coat, as may be applicable for preparation of the particular type of the substrate 102, is coated on a surface of the rigid substrate 102, for non-exclusive example, the primer is a metal primer, wood primer, plastic primer, composite primer or other primer, such as comprised of 20%-30% synthetic resin, 60%-80% solvent and 2%-5% additive agent or otherwise. An ink receptive layer 106 coats the primer and/or opaque layer 104.

The ink receptive layer 106 comprises a binder system, a pigment system and additives. Suitable binder system for the ink receptive layer 106 includes poly-vinyl ethanol (PVOH), ethyl vinyl acetate (EVA), poly-urethane dispersion (PUD), Latex, other similar compositions, and selected combinations of these, as non-exclusive example, a PVOH and EVA blend or otherwise. Pigment system for the ink receptive layer 106 includes aluminum oxides, calcium carbonates, titanium oxides, silicon oxides, and others, as non-exclusive example, selected blends of these pigments such as combinations of aluminum and silicon oxides or others. Additives of the ink receptive layer 106 include de-foamers, surfactants, matting additives, cross-linkers, and others, as well as any suitable combinations.

The ratios of the binder system, the pigment system and additives of the ink receptive layer, although variable depending on the type of pigment, include as non-exclusive examples the following:

| Component | % solid content |
|---|---|
| Binder system (Majority PVOH and EVA) | 12% |
| Pigment system (Majority Silicon oxide and Calcium carbonate) | 17% |
| Additives | 3% |

Example 1

| Component | % solid content |
|---|---|
| Binder system (Majority High molecular weight PVOH) | 5% |
| Pigment system (Majority Aluminum oxides) | 25% |
| Additives | 1% |

Example 2

Figure 2:
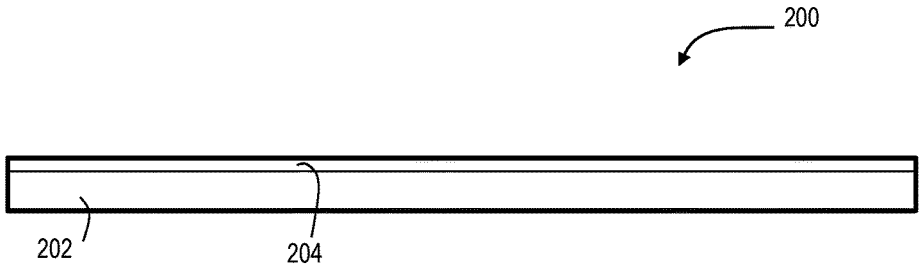
FIG. 2 illustrates a system of an ink receptive layer deposited on a rigid substrate, for inkjet printing directly onto the ink receptive layer of a photo, digital art or art reproduction piece, according to certain embodiments.

Referring to FIG. 2, a system 200 includes a rigid substrate 202 coated by an ink receptive layer 106. The rigid substrate 202 is any suitable artwork or other substrate material that is significantly rigid, as non-exclusive example, a metal, wood, plastic, composite or other. The ink receptive layer 204 directly coats the rigid substrate 202.

The ink receptive layer 204 comprises a binder system, a pigment system and additives. Suitable binder system for the ink receptive layer 204 includes poly-vinyl ethanol (PVOH), ethyl vinyl acetate (EVA), poly-urethane dispersion (PUD), Latex, other similar compositions, and selected combinations of these, as non-exclusive example, a PVOH and EVA blend or otherwise. Pigment system for the ink receptive layer 204 includes aluminum oxides, calcium carbonates, titanium oxides, silicon oxides, and others, as non-exclusive example, selected blends of these pigments such as combinations of aluminum and silicon oxides or others. Additives of the ink receptive layer 204 include de-foamers, surfactants, matting additives, cross-linkers, and others, as well as any suitable combinations.

The ratios of the binder system, the pigment system and additives of the ink receptive layer 204, although variable depending on the type of pigment, include as non-exclusive examples those ratios provided in the foregoing Example 1 and Example 2.

Figure 3:
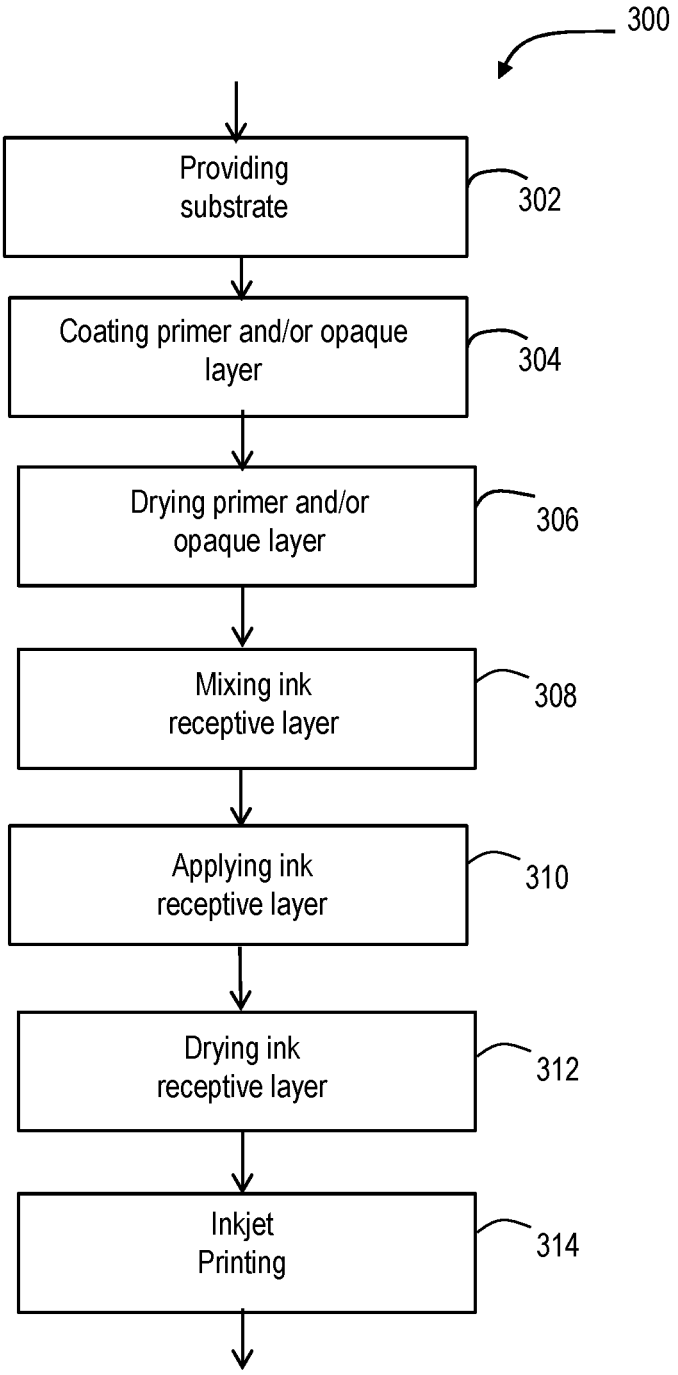
FIG. 3 illustrates a method of direct inkjet printing of a photo, digital art or art reproduction piece onto a rigid substrate coated with an ink receptive layer, according to certain embodiments.

Referring to FIG. 3, a method 300 of direct inkjet printing of a photo, digital art or art reproduction piece includes a step 302 of providing a rigid substrate of desired size and shape. A next step 304 includes coating a surface of the rigid substrate with a primer and/or opaque layer. The primer and/or opaque layer from the step 304 is dried in a step 306. In certain embodiments of the method 300, the steps 304 and 306 need not be performed, as non-exclusive example, if the surface of the rigid substrate is suitably colored, textured and/or otherwise configured or selected.

A combination of binder system, pigment system and additives are mixed in a step 308 for application as an ink receptive layer. In a step 310, the ink receptive layer is applied onto the surface of the rigid substrate. If the steps 304 and 306 have been performed in the embodiment of the method 300, the ink receptive layer is applied onto the primer and/or opaque layer. If the steps 304 and 306 have not been performed in the embodiment, the ink receptive layer is applied directly to the surface of the rigid substrate. The ink receptive layer is dried in a step 312.

Upon the step 312, direct inkjet printing is made onto the dried ink receptive layer.

In particular examples of certain embodiments, a variety of inkjet printers capable of printing to rigid or substantially rigid materials may be employed for the systems and methods. Additionally, a variety of types of inks may be employed. One non-exclusive example is a water based ink and inkjet print device, such as Epson™ UltraChrome HDR Ink technology.

In addition to variations in types of ink, the particular combinations of binder system, pigment system and additives of the ink receptive layer, as well as ratios of components thereof, are variable to provide desired gloss level required on the finished product and applicable ink absorption rate.

In certain non-exclusive examples, the rigid substrate may be any suitable substrate as example metal, wood or plastic. The primer layer or opaque layer, when presented, may include any suitable composition and may be applied in any suitable manner. For example, requirements and thickness of this layer will vary based on the type of substrate being used, and the thickness of this layer can range from about 0 mm to about 1 mm or otherwise. The ink receptive layer is variable in composition, type and thickness of deposition, for example, as may be applicable for particular inkjet printer that is employed. Other non-exclusive factors can affect the type and thickness of the layer, such as gloss level to be achieved and type of inks being used, and thickness of this layer can range from about 0.005 mm to about 1 mm or otherwise. In certain non-exclusive examples, the cumulative thickness of rigid substrate, plus primer and/or opaque layer (if applicable), plus the ink receptive layer, can be on the order of about 2 mm or as otherwise applicable based on capacity of the particular inkjet printer that is employed.

According to certain non-exclusive examples, certain of the embodiments may be employed with swell-able and/or porous inkjet technologies, for example, the example inkjet receptive layer so described may be for porous type and based on size of the pigment being used in order to yield desired gloss level of the finished product. A smaller particle size may, for example, show higher gloss than bigger particle size.

In the examples of certain embodiments, the composition of the ink receptive layer is applied in liquid form to the substrate, for example, through Curtain coating, blade coating and wire rod system, or any similar type system, method or process. The particular wet film thickness of the ink receptive layer applied is determined based on the solid content of the composition being used, for example, to target a dry film thickness range from about 0.005 mm to about 1.0 mm or otherwise.

In certain examples, drying of the ink jet layer composition applied to the substrate may include infrared drying, hot air circulation, other drying technology, or combinations.

In the foregoing, the invention has been described with reference to specific embodiments. One of ordinary skill in the art will appreciate, however, that various modifications, substitutions, deletions, and additions can be made without departing from the scope of the invention. Accordingly, the specification and figures are to be regarded in an illustrative rather than a restrictive sense, and all such modifications substitutions, deletions, and additions are intended to be included within the scope of the invention. Any benefits, advantages, or solutions to problems that may have been described above with regard to specific embodiments, as well as device(s), connection(s), step(s) and element(s) that may cause any benefit, advantage, or solution to occur or become more pronounced, are not to be construed as a critical, required, or essential feature or element.

What is claimed is:

1. A system for imprinting artwork and photography, consisting of:

a rigid substrate having a surface, the rigid substrate selected from the group consisting of: metal and wood; and an ink receptive layer coating the surface of the rigid substrate, the ink receptive layer having a thickness from about 0.005 mm to about 1 mm of:

(i) dispersing pigment selected from the group consisting of: aluminum oxide, silicon oxide, calcium carbonate, titanium oxide, and combinations of these;

(ii) binder selected from the group consisting of: polyvinyl ethanol (PVOH), ethyl vinyl acetate (EVA), poly-urethane dispersion (PUD), latex polymer, and combinations of these; and an inkjet print onto the ink receptive layer forming a high quality artwork image.

2. The system of claim 1, further consisting of:

a layer coated on the surface of the rigid substrate, the layer selected from the group consisting of: primer layer and opaque layer, wherein the ink receptive layer is coated over the layer and the inkjet print is onto the layer.

3. The system of claim 2, wherein the ink receptive layer includes other additives selected from the group consisting of: de-foamers, surfactants, matting additives, cross-linkers, and combinations of these.

4. The system of claim 3, wherein the binder is about 5% to about 12% solid content, the dispersing pigment is about 17% to about 25% solid content, and the additives are about 1% to about 3% solid content.

5. The system of claim 1, wherein the ink receptive layer includes other additives selected from the group consisting of: de-foamers, surfactants, matting additives, cross-linkers, and combinations of these.

6. The system of claim 5, wherein the binder is about 12% solid content, the dispersing pigment is about 17% solid content, and the additives are about 3% solid content.

7. The system of claim 5, wherein the binder is about 5% solid content, the dispersing pigment is about 25% solid content, and the additives are about 1% solid content.

8. The system of claim 5, wherein the binder is about 5% to about 12% solid content, the dispersing pigment is about 17% to about 25% solid content, and the additives are about 1% to about 3% solid content.

9. The system of claim 1, wherein the dispersing pigment is selected from the group consisting of: aluminum oxide, calcium carbonate, titanium oxide, silicon oxide, and combinations of these.

10. The system of claim 9, further consisting of:

a layer coated on the surface of the rigid substrate, the layer selected from the group consisting of: primer layer and opaque layer, wherein the ink receptive layer is coated over the layer.

11. The system of claim 10, wherein the ink receptive layer further includes additives selected from the group consisting of: de-foamer, surfactant, matting additive, cross-linker, and combinations of these.

12. The system of claim 9, wherein the ink receptive layer further includes additives selected from the group consisting of: de-foamer, surfactant, matting additive, cross-linker, and combinations of these.

* * * * *